United States Patent [19]

Ogawa et al.

[11] Patent Number: 4,630,573

[45] Date of Patent: Dec. 23, 1986

[54] COOLING SYSTEM FOR AUTOMOTIVE ENGINE OR THE LIKE

[75] Inventors: Naoki Ogawa, Yokohama; Takao Kubozuka, Yokosuka; Yoshinori Hirano, Yokohama, all of Japan

[73] Assignee: Nissan Motor Co., Ltd., Yokohama, Japan

[21] Appl. No.: 779,395

[22] Filed: Sep. 23, 1985

[30] Foreign Application Priority Data

Sep. 29, 1984 [JP] Japan ..... 59-202950

[51] Int. Cl.[4] ..... F01P 3/22

[52] U.S. Cl. ..... 123/41.27; 123/41.44

[58] Field of Search ..... 123/41.2–41.27, 123/41.44

[56] References Cited

U.S. PATENT DOCUMENTS 4,205,944 6/1980 Rohrberg et al. ..... 123/41.44

4,557,223 12/1985 N Gueyen ..... 123/41.44

FOREIGN PATENT DOCUMENTS 3346511 11/1984 Fed. Rep. of Germany ... 123/41.27

56-32028 4/1981 Japan ..... 123/41.24

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to obviate vapor locking and subsequent cavitation of a pump which returns coolant vapor condensate from a radiator to the coolant jacket of an evaporative type cooled internal combustion engine and maintains the highly heated structure of the engine immersed in a predetermined depth of liquid coolant, the load on the pump is sensed by determining the amount of electrical current the pump is drawing and in the event that the load is at a level indicative of pump cavitation the connection between the radiator and the pump is interrupted and communication between a reservoir and the pump is established so as to introduce cool liquid coolant into the induction port of the pump.

10 Claims, 11 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is permitted to boil and the vapor used as a vehicle for removing heat from the engine, and more specifically to such a system wherein pump vapor lock and resulting pump cavitation which occurs when the coolant contained in the cooling circuit reaches a saturation temperature can be obviated.

2. Description of the Prior Art

In currently used 'water cooled' internal combustion engine such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the necessary amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kgm of water may effectively remove from the engine under such conditions is 4 Kcal. Accordingly, in the case of an engine having 1800 cc displacement (by way of example) is operated full throttle, the cooling system is required to remove approximately 4000 Kcal/h. In order to achieve this, a flow rate of 167 liter/min (viz., $4000-60\times\frac{1}{4}$) must be produced by the water pump. This of course undesirably consumes a number of useful horsepower.

FIG. 2 shows an arrangement disclosed in Japanese Patent Application Second Provisional Publication Sho. No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer.

The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. Accordingly, air, due to this inherent tendency to rise, forms pockets of air which cause a kind of 'embolism' in the radiator and badly impair the heat exchange ability thereof.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the 'dry' gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial on-condensible matter to be forced out of the system, suffer from rapid loss of coolant when operated at relatively high altitudes. Further, once the engine cools air is relatively freely admitted back into the system.

The provision of the separation tank 6 also renders engine layout difficult in that such a tank must be placed at relatively high position with respect to the engine, and contain a relatively large amount of coolant so as to buffer the fluctuations in coolant consumption in the coolant jacket. That is to say, as the pump 11 which lifts the coolant from the small reservoir arrangement located below the radiator, is constantly energized (apparently to obivate the need for level sensors and the like arrangement which could control the amount of coolant returned to the coolant jacket) the amount of coolant stored in the seperation tank must be suffucient as to allow for sudden variations in the amount of coolant consumed in the coolant jacket due to sudden changes in the amount of fuel combusted in the combustion chambers of the engine.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with only gaseous coolant during engine operation during which liquid coolant is sprayed onto the ceramic layers 12. However, this arrangement has proven totally unsatisfactory in that upon boiling of the liquid coolant absorbed into the eramic layers, the vapor thus produced and which escapes into the coolant jacket inhibits the penetration of fresh liquid coolant and induces the situation wherein rapid overheat and thermal damage of the ceramic layers 12 and/or engine soon results. Further, this arrangement is plagued with air contamination and blockages in the radiator similar to the compressor equipped arrangement discussed above.

FIG. 7 shows an arrangement which is disclosed in copending U.S. patent application Ser. No. 663,911 filed on Oct. 23, 1984 in the name of Hirano, now U.S. Pat. No. 4,549,505. The disclosure of this application is hereby incorporated by reference thereto. For convenience the same numerals as used in the just mentioned application are also used in FIG. 7 so as to facilitate ready understanding of same.

However, this arrangement while overcomming many of the problems encountered by the prior art by (a) filling the cooling circuit defined by coolant jacket, radiator and interconnecting conduiting with coolant from an auxiliary reservoir when the engine is stopped and (b) performing non-condensible matter purges when the engine is subject to cold starts, has itself encounted the drawback that if operated at high load and/or in a hot climate for an extended period the whole system tend to become heated to the point that the coolant condensate collected at the bottom of the radiator is close to boiling. Under such conditions as the coolant is relatively easy to vaporize when exposed to low pressures it sometimes occurs that the pump which returns the coolant from the radiator to the coolant jacket tends to become "vapor locked" and begins cavitating. This of course induces the problem that although the system is apparently operating in a proper manner the vital coolant which must be returned to the coolant jacket in order to maintain the highly heated structure of the engine securely immersed in sufficient coolant as to prevent localized "dryouts" and subsequent localized thermal damage to the engine, does not get returned and the engine seizes or undegoes similar thermal damage.

SUMMARY OF THE PRESENT INVENTION

It is an object of the present invention to provide an evaporative type cooling system for an internal combustion engine or the like which can assuredly detect and obviate pump cavitation upon the system reaching a saturation temperature whereat all of the coolant in the cooling circuit of the engine has become heated due to operation of the engine and further execute measures to overcome the same.

In brief, the above object is achieved by an arrangement wherein in order to obivate vapor locking and subsequent cavitation of a pump which returns coolant vapor condensate from a radiator to the coolant jacket of an evaporative type cooled internal combustion engine and maintains the higly heated structure of the engine immersed in a predetermined depth of liquid coolant, the load on the pump is sensed by determining the amount of electrical current the pump is drawing and, in the event that the load is at a level indicative of pump cavitation, interrupt the connection between the radiator and the pump and establish communication between a reservoir and the pump so as to introduce cool liquid coolant into the induction port of the pump.

A first aspect of the present invention comes in the form of an internal combustion engine having a structure subject to high heat flux and a cooling system comprising: (a) a cooling circuit for removing heat from the structure, the cooling circuit comprising: a coolant jacket disposed about the structure and into which coolant is introduced in liquid form and permitted to boil; a radiator in which coolant vapor is condensed to its liquid form; a vapor transfer conduit leading from a vapor collection spaced defined in the coolant jacket, to the radiator; means for returning liquid coolant from the radiator to the coolant jacket in a manner which maintains the structure immersed in a predetermined depth of liquid coolant, the liquid coolant returning means including: a coolant return conduit leading from the bottom of the radiator to the coolant jacket, and a pump disposed in the coolant return conduit, the pump being selectively energizable to return coolant from the radiator to the coolant jacket through the coolant return conduit; (b) a reservoir in which liquid coolant is stored; (c) valve and conduit means for selectively providing fluid communication between the reservoir and the cooling circuit, the valve and conduit means comprising: a first valve disposed in the coolant return conduit at a location between the radiator and the pump, and a first conduit leading from the reservoir to the valve, the first valve having a first position wherein communication between the radiator and the pump is established and communication between the pump and the first conduit cut-off, and a second position wherein communication between the radiator and the pump is cut-off and communication between the reservoir and the pump is established via the first conduit; and (d) means for sensing the load on the pump when energized and for causing the first valve to assume the first position when the load on the pump is above a predetermined minimum limit and for causing the first valve to assume the second position in response to the load on the pump being equal to or lower than the predetermined minimum level.

A second aspect of the present invention comes in a method of cooling an engine having a structure subject to high heat flux, which method comprises the steps of: introducing liquid coolant into a coolant jacket disposed about the structure; permitting the coolant to boil and produce coolant vapor; condensing the coolant vapor produced in the coolant jacket to its liquid form in a radiator; using a pump to return the liquid coolant from the radiator to the coolant jacket in a manner which maintains the structure immersed in a predetermined depth of coolant; storing liquid coolant in a reservoir; sensing the load on the pump when energized; and interrupting the communication between the radiator and the pump and establishing fluid communication between the reservoir in which liquid coolant is stored and the pump in response to the step of sensing indicating that the load on the pump is equal to or lower than a predetermined minimum limit.

BRIEF DESCRIPTION OF THE DRAWINGS

The features and advantages of the arrangement of the present invention will become more clearly appreciated from the following description taken in conjunction with the following drawings in which.

DETAILED DESCRIPTION OF THE PREFERRED EMBODIMENT

Before proceeding with the description of the embodiments of the present invention, it is deemed appropriate to discuss same of the concepts on which the present invention is based.

Figure 1:
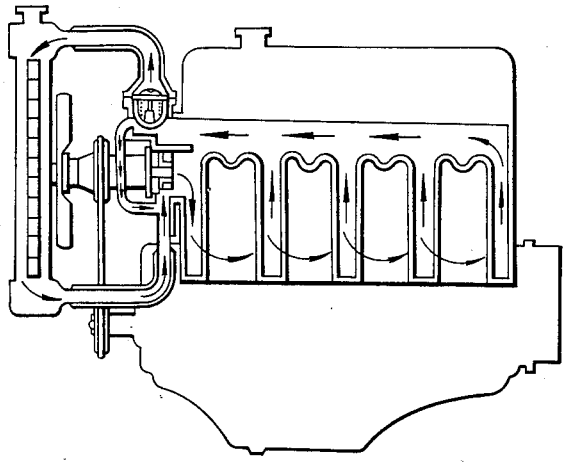
FIG.1 (PRIOR ART)
FIG. 1 is a sectional elevation showing the currently used conventional water circulation type system discussed in the opening paragraphs of the instant disclosure.
Figure 2:
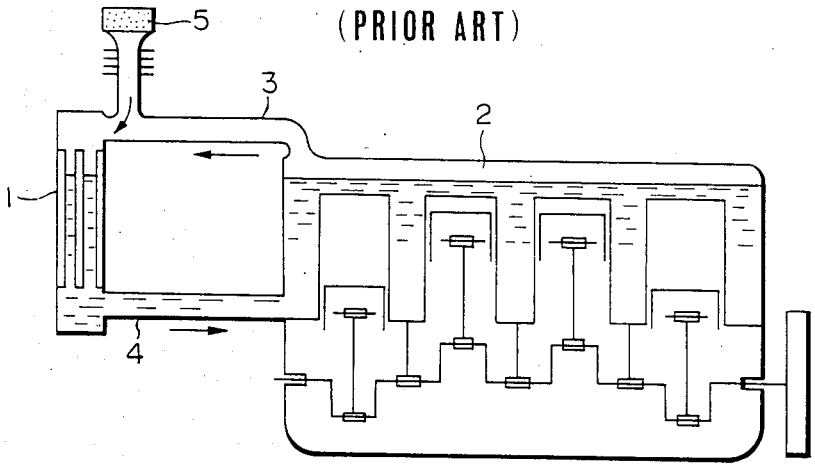
FIG.2 (PRIOR ART)
FIG. 2 is a schematic side sectional elevation of a prior art arrangement also discussed briefly in the earlier part of the specification.
Figure 3:
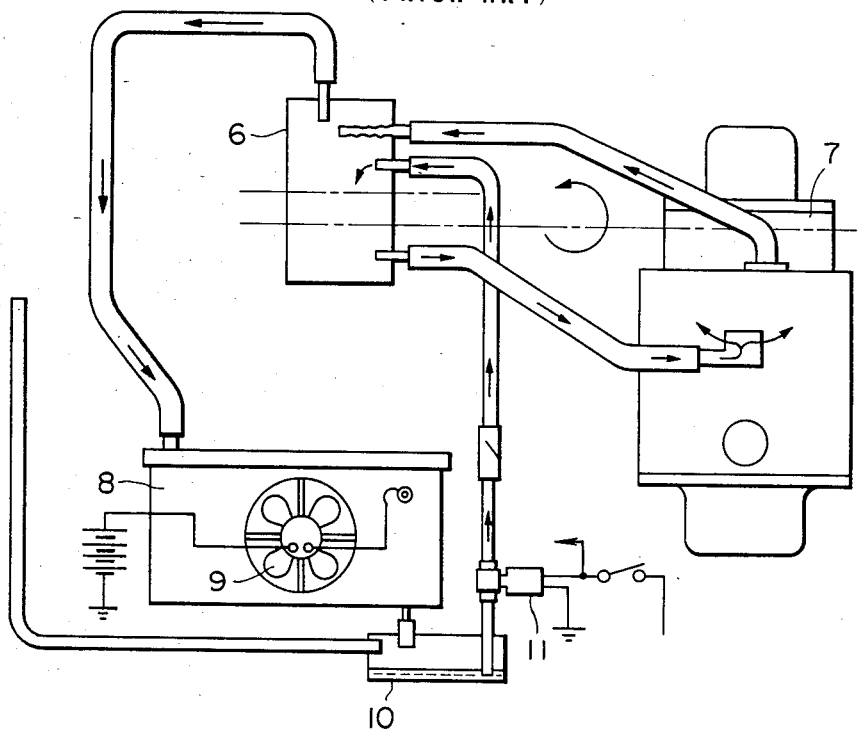
FIG. 3 (PRIOR ART)
FIG. 3 shows in schematic layout form, another of the prior art arrangements previously discussed.
Figure 4:
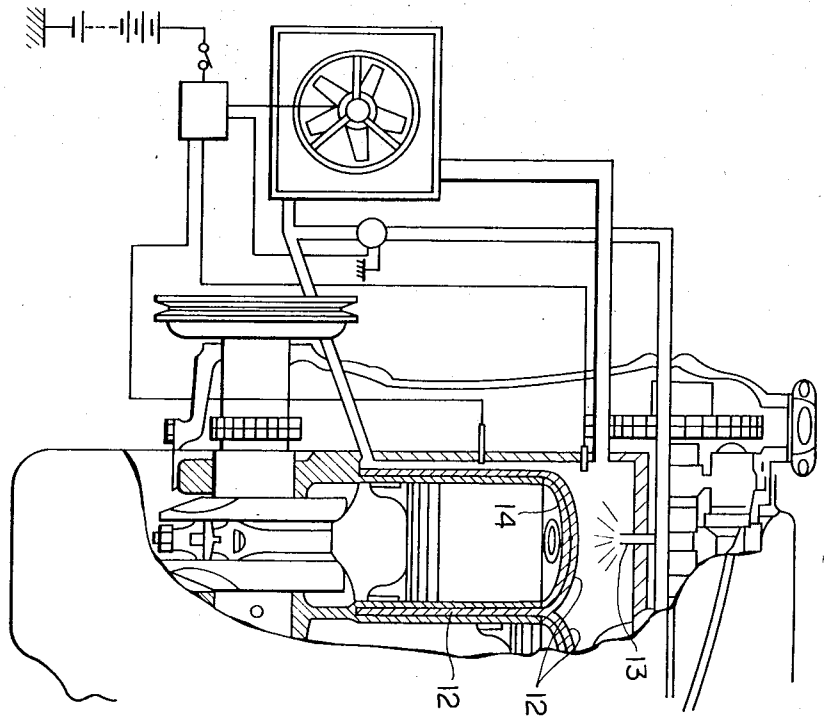
FIG.4 (PRIOR ART)
FIG. 4 shows in partial section yet another of the previously discussed prior art arrangements.
Figure 5:
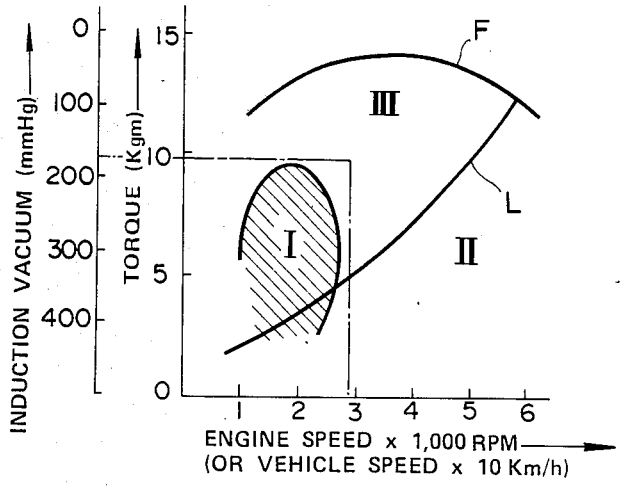
FIG. 5 is a graph showing in terms of induction vacuum (load) and engine speed the various load zones encountered by an automotive internal combustion engine.
Figure 6:
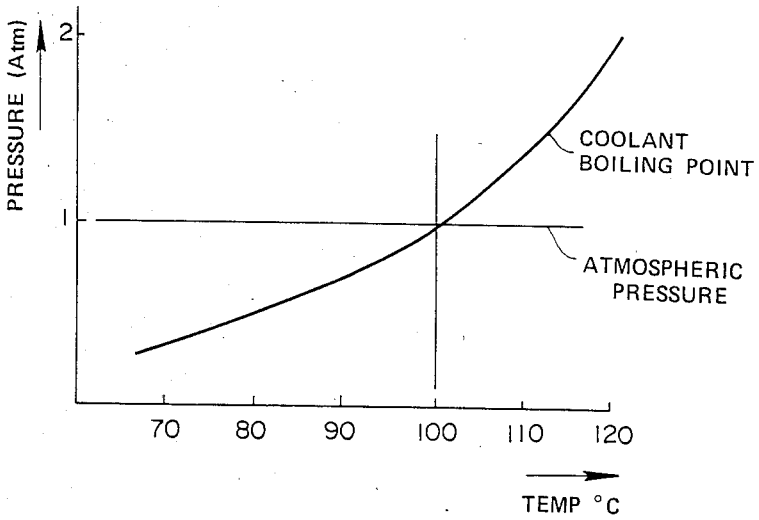
FIG. 6 is a graph showing in terms of pressure and temperature, the change which occurs in the coolant boiling point with change in pressure.

FIG. 5 graphically shows in terms of engine torque and engine speed the various load 'zones' which are encountered by an automotive vehicle engine. In this graph, the curve F denotes full throttle torque characteristics, trace L denotes the resistance encountered when a vehicle is running on a level surface, and zones I, II and III denote respectively 'urban cruising', 'high speed cruising' and 'high load operation' (such as hill-climbing, towing etc.).

A suitable coolant temperature for zone I is approximately 110° C. while 90°-80° C. for zones II and III. The high temperature during 'urban cruising' promotes improved thermal efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

Figure 7:
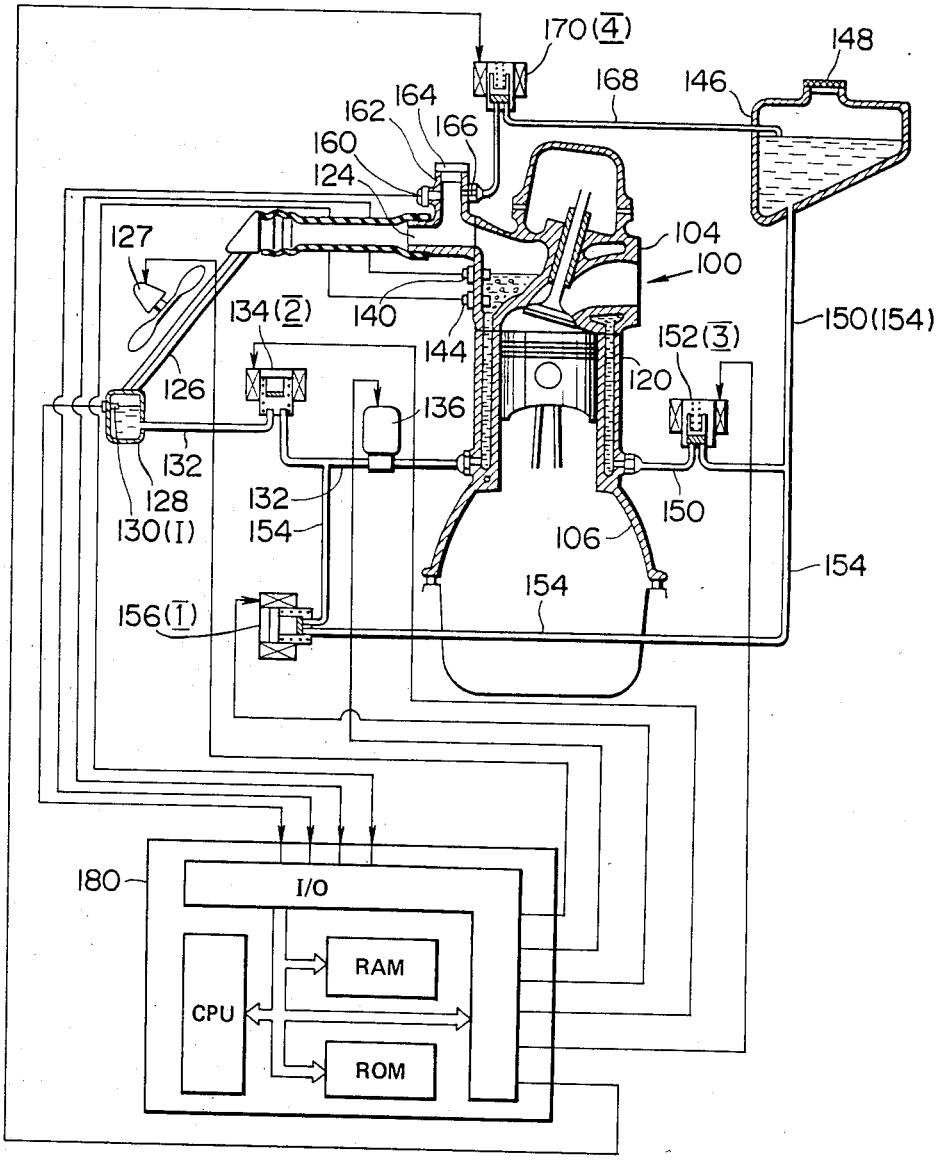
FIG. 7 shows in schematic elevation the arrangement disclosed in the opening paragraphs of the instant disclosure in conjunction with copending U.S. Ser. No. 661,911.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 7, wherein the engine coolant boils at temperatures above 100° C. for example at approximately 119° C. (corresponding to a pressure of approximately 1.9 Atmospheres).

On the other hand, during high speed cruising, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 90° C. However, under such conditions the tendency for air to find its way into the interior of the cooling circuit becomes excessively high and it is desirable under these circumstances to limit the degree to which a negative pressure is permitted to develop. This can be achieved by permitting coolant to be introduced into the cooling circuit from the reservoir and thus raise the pressure in the system to a suitable level.

Figure 8:
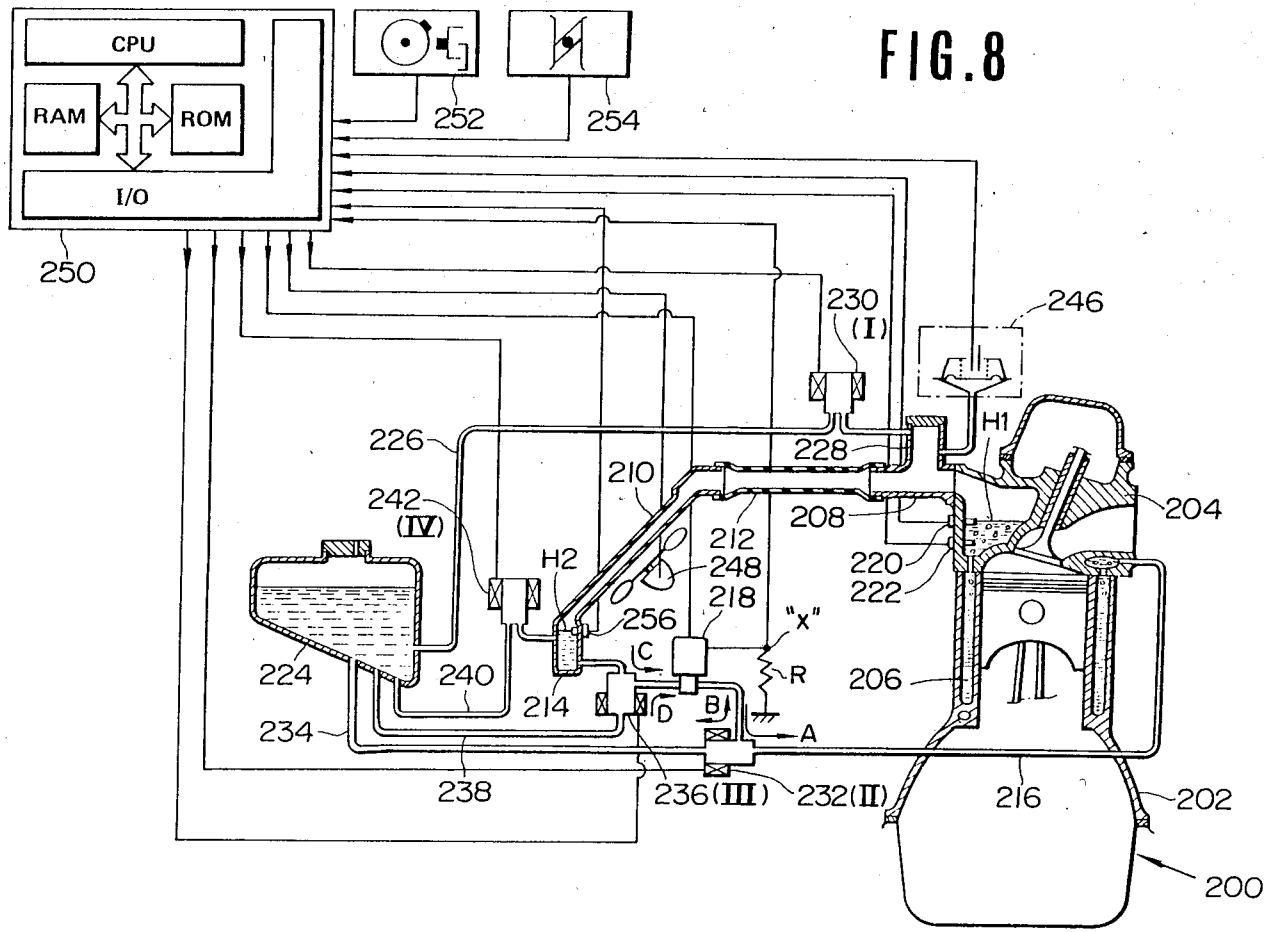
FIG. 8 shows an embodiment of the present invention.

FIG. 8 shows an embodiment of the present invention. In this arrangement an engine 200 includes a cylinder block 202 on which a cylinder head 204 is detachably mounted. The cylinder block and cylinder head are formed with cavities which define a coolant jacket 206 about the heated structure of the engine.

A vapor manifold 208 is detachably mounted on the cylinder head 204 and arranged to communicate with a condensor or radiator (as it will be referred to hereinafter) 210 via a vapor transfer conduit 212.

In this embodiment the radiator 210 comprises a plurality of relatively small diameter conduits which terminate in a small collection vessel or lower tank 214. A coolant return conduit 216 leads from the lower tank 214 to the coolant jacket 206. In this embodiment the return conduit 216 communicates with the cylinder head 204 at a location proximate the most highly heated structure of the engine 200. This arrangement introduces the relatively cool coolant into a section of the coolant jacket 206 where the most vigorous boiling tends to occur and therefore tends to attenuate the bumping and frothing which normally accompanies same. However, it is also within the scope of the present invention to connect the return conduit 216 to a port formed in the section of the coolant jacket 206 defined within the cylinder block 202 if so desired.

A small capacity coolant return pump 218 is disposed in conduit 216 as shown. This pump is aranged to be selectively energizable to pump coolant from said lower tank 214 toward the coolant jacket 206 (viz., a first flow direction) and in the reverse direction (second flow direction). The reason for this arrangement will become clear hereinlater.

In order to control the operation of pump 218 (in the first flow direction) a first level sensor 220 is disposed in the coolant jacket. As shown this level sensor 220 is arranged at a level H1 which is selected to be a predetermined height above the structure which defines the cylinder heads, exhaust ports and valves of the engine (viz., structure subject to a high heat flux) so as to maintain same immersed in sufficient coolant and thus obviate the formation of localized dryouts (induced by excessively violent bumping and frothing of the coolant) and thus avoid engine damage due to localized overheating and the like. This sensor may be arranged to exhibit hysteresis characteristics so as to prevent rapid ON/OFF cycling of pump 218.

Disposed below the level sensor 220 so as to be securely immersed in liquid coolant and in relatively close proximity to the most highly heated structure of the engine is a temperature sensor 222.

A reservoir 224, the interior of which is maintained constantly at atmospheric pressure, is arranged to fluidly communicate with what shall be referred to as a 'cooling circuit' (viz., a circuit comprised of the coolant jacket 206, the vapor manifold 208, the vapor transfer conduit 212 and coolant return conduit 216) via a 'valve and conduit' arrangement. In this embodiment the valve and conduit arrangement comprises an overflow conduit 226 which leads from a riser 228 formed in the vapor manifold 208; a first valve 230 which normally closes the overflow conduit 226 and which permits communication between the riser 228 and the reservoir 224 upon energization; a second (three-way) valve 232 disposed in the coolant return conduit 216 and which is arranged to have a first position wherein communication between the pump 218 and the coolant jacket 206 is established (viz., establish flow path A) and a second position wherein communication between the pump 216 and the reservoir 224 is established (flow path B) via an induction conduit 234; a third (three-way) valve 236 disposed in the coolant return conduit 216 at a location between the lower tank 214 and pump 218 and which has a first position wherein communication between the lower tank 214 and the pump 218 is established (flow path C) and a second position wherein communicationi between the reservoir 224 and pump 218 is established via an anti-cavitation conduit 238 (flow path D); a fill displacement conduit 240 which leads from the reservoir 224 to the lower tank 214; and a fourth valve 242 which permits communication between the lower tank 214 and the reservoir 224 when de-energized and which cuts-off said communication upon energization.

In order to sense the pressure prevailing in the cooling circuit a pressure differential responsive switch arrangement 246 is arranged to communicate with the riser 228 as shown. This switch is arranged to be triggered to output a signal upon the pressure in the vapor manifold 208 dropping a predetermined amount below ambient atmospheric pressure.

A small electric fan 248 or like device is disposed beside the radiator 210 and arranged to force a draft of air over the surface thereof and thus induce an increase in the heat exchange between the radiator and the surrounding atmospheric air.

A control circuit 250 which in this embodiment includes a microprocessor comprising a CPU, a RAM a ROM and an in/out interface I/O is arranged to receive inputs from temperature sensor 222 and level sensor 220. This circuit also receives data inputs from an engine speed sensor 252, a engine load sensor 254 and a second level sensor 256 disposed in lower tank 214 at a level essentially equal to that at which the fill/discharge conduit 240 communicates with same.

The ROM of the microprocessor contains various control programs which are used to control the operation of the fan, pump and valves, and of the valve and conduit arrangement. These programs will be discussed in detail hereinlater.

Prior being put into use it is necessary to completely fill the cooling circuit with coolant and displace any non-condensible matter. To do this it is possible to remove the cap (no numeral) which closes the riser 228 and manually fill the system with liquid coolant (for example water or a mixture of water and anti-freeze). Alternatively, or in combination with the above, it is possible to introduce excess coolant into reservoir 224, condition valve 236 to produce flow path D, valve 232 to produce flow path A and energize pump 218 until such time as coolant may be visibly seen spilling out of the open riser 228. By securing the cap in place at this time it is possible to hermetically seal the system in a completely filled condition.

Figure 9:
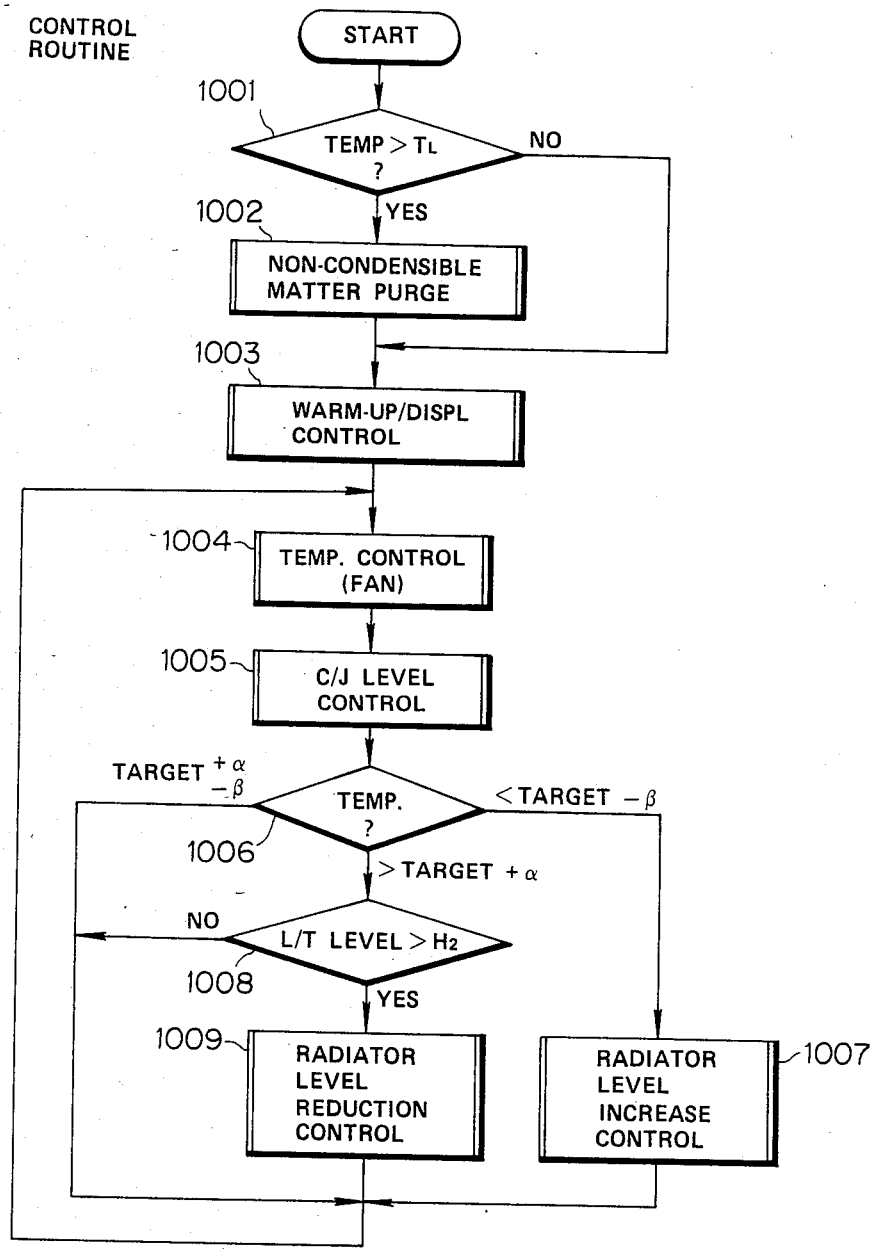
FIGS. 9 to 11 show flow charts which depict the operations which characterize the operation of the arrangement shown in FIG. 8.

FIG. 9 shows in flow chart form a control routine which manages the overall operation of the cooling system shown in FIG. 8. As shown, subsequent to start of the engine and initialization of the system, the coolant temperature is determined by sampling the output of temperature sensor 222 at step 1001. In the event that the coolant temperature is below a predetermined level ($T_L$) which in this case is selected to be 45° C., the control program flows to step 1002 wherein a non-condensible matter purge sub-routine is run. However, if the temperature is above 45° C. then the program bypasses the purge operation and proceeds directly to step 1003 on the assumption that as the coolant is still warm, the engine has not cooled sufficiently and there has been insufficient time for atmospheric air or the like to have leaked into and contaminated the cooling circuit of the engine.

At step 1003 a warm-up/displacement mode of operation is entered. During this routine any excess coolant which has entered the cooling circuit while the engine was stopped will be displaced until (a) the coolant boils at a temperature which is deemed appropriate for the instant mode of engine operation or (b) a minimum amount of coolant (viz., the coolant in the coolant jacket 206 and lower tank 214 both assume level H1 and H2 respectively).

It should be noted that when the engine is stopped and has assumed a predetermined condition under the control of a 'shut-down' control routine (not shown), that liquid coolant from the reservoir 224 is permitted to be introduced into the coolant circuit under the influence of the pressure differential which develops as the coolant vapor condenses to its liquid state. Accordingly, depending on the temperature of the coolant and the amount of coolant vapor which is present in the cooling circuit, the latter will tend to be partially to completely filled with liquid coolant.

Following the coolant displacement the control program flows to step 1004 wherein the operation of the fan 248 is controlled in a manner to maintain the temperature of the coolant in the coolant jacket 206 at a level which is deemed to be most appropriate for the instant set of engine operational conditions.

At step 1005 a pump control routine is implemented in order to maintain the level of coolant in the coolant jacket at H1. Following this the temperature of the coolant is determined in step 1006 and ranged in a manner that if within a range of target $+\alpha$ to target $-\beta$ then the program flows to back to step 1004. However, if the temperature is lower than target $-\beta$ then at step 1007 a routine which increases the level of coolant in radiator 210 is implemented while if the temperature is greater than target $+\alpha$ then at step 1008 the level of coolant in the lower tank 214 is determined by sampling the output of level sensor 256. In the event that the level of coolant in the lower tank 214 is above H2 then the program proceeds to step 1009 wherein a radiator level reduction control routine is run. However, if the outcome of the enquiry carried out at step 1008 indicates that the level of coolant is not above H2 then the program recycles to step 1004.

Figure 10:
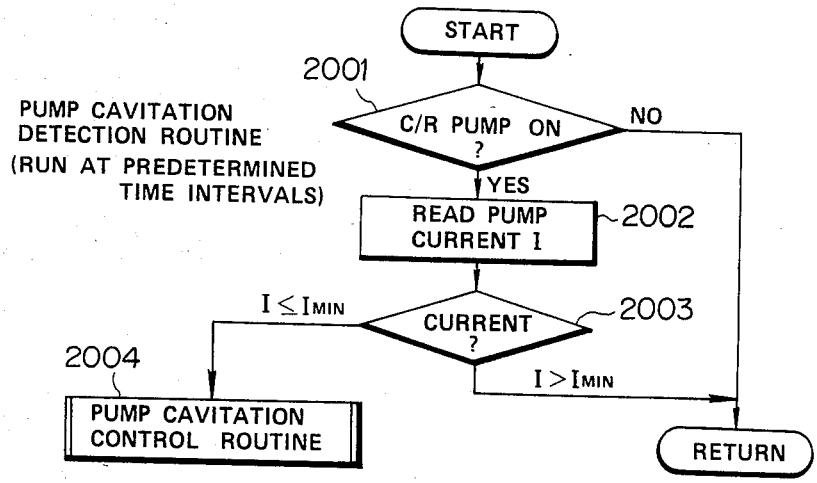
Figure 11:
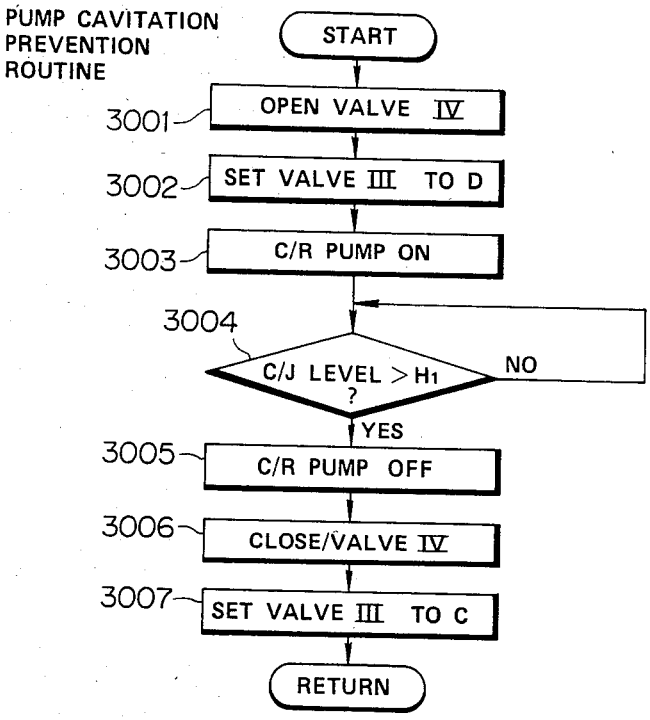

Before proceeding with a description of the flow charts shown in FIGS. 10 and 11, it is deemed advatageous from the viewpoint of fully comprehending the present invention to discuss how the cavitation which plagues the arrangement of FIG. 7 is detected and overcome. As will be appreciated if the pump is switched on in response to a signal from level sensor 220 indicating that insufficient coolant is contained in the engine coolant jacket 206, a given amount of work must be done by the pump in order to move the liquid coolant from the lower tank 214 to the coolant jacket 206 via return conduit 216. Accordingly, while liquid coolant is being inducted into the pump 218 and subsequently discharged therefrom, the pump will consume a corresponding amount of electrical energy. Thus, by measuring the amount of electrical current which is flowing through the motor of the pump 218, it is possible to sense the load on the same. In the illustrated embodiment (FIG. 8) the pump is arranged to be grounded through a known resistance R and the voltage appearing at terminal "x" sampled.

Using the equation:

$$V = I \cdot R$$

wherein:

V is the voltage appearing at "x";

I is the current flowing through the motor of pump 218; and

R is the resistance of resistor R then it is an easy matter to determine the load on the pump simply by sampling the voltage in the above described manner.

In the event that the current passing through the pump motor is sensed as rising above a predetermined minimum level it can be assumed that either the pump is cavitating or alternatively that there is no coolant in the lower tank 214 available for induction. Under such circumstances as the pump is ON—indicating that coolant is required in the coolant jacket 206—steps are taken to switch valve 236 to establish flow path D and permit the pump to induct fresh (cool) coolant from the reservoir 224 via anti-cavitation conduit 238. In the event that the pump is cavitating due to the tendancy to vapor lock when the coolant in the lower tank 214 reaches saturation temperature, the introduction of cool coolant from the reservoir obviates the problem and ensures an adequate supply of coolant to the coolant jacket. During subsequent runs of the control routine (FIG. 9) the excess coolant which may have been thus introduced is adjusted at step 1009.

FIG. 10 shows a cavitation detection routine which is implemented by the CPU of the microprocessor (control circuit 250) at regular intervals.

As shown, subsequent to the start of this routine, the status of pump 218 is determined at step 2001. If the pump is not ON then the program returns to a suitable control routine. However, if the pump is detected as being ON then at step 2002 the voltage at "x" is sampled and the amount of current being drawn by the pump motor determined at step 2003. If the amount of current actually being used by the pump is above a predetermined minimum level then the program returns. On the other hand, if the current level is equal to or lower than the minimum level then at step 2004 a pump cavitation control or prevention routine is implemented.

FIG. 11 shows the steps which characterize the above mentioned prevention routine. As shown at steps 3001 to 3003 the system is conditioned so that valve IV (242) is opened, valve III (236) is set to establish flow path D and a command to energize the motor of pump 218 issued. Under these conditions, coolant is inducted from reservoir 224 via conduit 238 and introduced into coolant jacket 206. As valve IV is open as this time the introduction of coolant into the system does not cause an increase in the cooling circuit pressure and an associated undesirable increase in the coolant boiling point.

At step 3004 the level of coolant in the coolant jacket is sampled and in the event that the level therein is not above H1 then the program recycles to permit the pump 218 to run and for more coolant to be introduced into the coolant jacket 206. However, if sufficient coolant is found to be in the coolant jacket then the program flows to steps 3005 to 3007 wherein the operation of pump 218 is terminated valve 242 closed and valve 236 conditioned to produce flow path C. Following this, the CPU resumes the running of the control routine of FIG. 9.

For further disclosure relating the control of pump 218 (which is preferably reversible so as to enable coolant to be forced in and out of the cooling circuit as the situation demands) and valves 230, 232 and 242, reference may be had to copending U.S. patent application Ser. No. 751,536 filed on July 3, 1985 in the name of Hirano et al which is hereby incorporated by reference thereto.

This document details measures which may be exacted to rapidly bring the temperature prevailing in the cooling circuit to the desired value by adding or removing coolant from the coolant circiut in a manner which varies both the pressure and the surface area of the radiator available for releasing the latent heat of evaporation of the coolant vapor to the ambient atmosphere (cooling medium) which surrounds the radiator.

What is claimed is:

1. In an internal combustion engine having a structure subject to high heat flux, a cooling system comprising:

(a) a cooling system for removing heat from said structure, said cooling system comprising:

a coolant jacket disposed about said structure and into which coolant is introduced in liquid form and permitted to boil;

a radiator in which coolant vapor is condensed to its liquid form;

a vapor transfer conduit leading from a vapor collection spaced defined in said coolant jacket to said radiator;

means for returning liquid coolant from said radiator to said coolant jacket in a manner which maintains said structure immersed in a predetermined depth of liquid coolant, said liquid coolant returning means including:

a coolant return conduit leading from the bottom of said radiator to said coolant jacket, and a pump disposed in said coolant return conduit, said pump being selectively energizable to return coolant from said radiator to said coolant jacket through said coolant return conduit;

(b) a reservoir in which liquid coolant is stored;

(c) valve and conduit means for selectively providing fluid communication between said reservoir and said cooling circuit, said valve and conduit means comprising:

a first valve disposed in said coolant return conduit at a location between said radiator and said pump, and a first conduit leading from said reservoir to said valve, said first valve having a first position wherein communication between said radiator and said pump is established and communication between said pump and said first conduit cut-off, and a second position wherein communication between said radiator and said pump is cut-off and communication between said reservoir and said pump is established via said first conduit; and means for sensing the load on said pump when energized and for causing said first valve to assume said first position when the load on the pump is above a predetermined minimum limit and for causing said first valve to assume said second position in response to the load on said pump being equal to or lower than said predetermined minimum level.

2. A cooling system as claimed in claim 1, wherein said sensing means takes the form of a circuit which is responsive to the voltage developed at a terminal located between said pump and a grounded resistance of known value.

3. A cooling system as claimed in claim 2 further comprising:

a second conduit leading from an upper section of said cooling circuit to said reservoir;

a second valve disposed in said second conduit, said second valve having a first position wherein communication between said cooling circuit and said reservoir via said second conduit is cut-off and a second position wherein communication is permitted;

a third valve disposed in said coolant return conduit at a location between said pump and said coolant jacket, said third valve having a first position wherein communication between said pump and said coolant jacket is established and a second position wherein communication between said reservoir and said pump is established via a third conduit which leads from said reservoir to said third valve, said pump being reversible so as to enable coolant to be pumped into or out of said coolant circuit when said third valve is in said second position;

a fourth conduit which leads from said reservoir to the bottom of said radiator;

a fourth valve disposed in said fourth conduit; said fourth valve having a first position wherein communication between said reservoir and said radiator is cut-off and a second position wherein communication is permitted.

4. A cooling system as claimed in claim 3, further comprising a switch arrangement which is responsive to the pressure differential which exists between the interior of said coolant jacket and the ambient atmosphere.

5. A cooling system as claimed in claim 4, further comprising a temperature sensor for sensing the temperature of the coolant in said coolant jacket.

6. A cooling system as claimed in claim 5, wherein said liquid coolant returning means includes a first level sensor disposed in said coolant jacket at a predetermined height above said structure, the output of said first sensor being used to control said pump.

7. A cooling system as claimed in claim 6, further comprising a device disposed with said radiator for increasing the rate of heat exchange between the radiator and a cooling medium which surrounds said radiator.

8. A cooling system as claimed in claim 7, further comprising an engine load sensor and a second level sensor disposed at the bottom of said radiator for sensing the level of coolant in the raditor being at a predetermined low level.

9. A cooling system as claimed in claim 8, wherein said load sensing means further includes means for controlling said device, said pump and said second, third and fourth valves in response to the data supplied from said temperature sensor, said engine load sensor, and the first and second level sensors.

10. In an internal combustion engine having a structure subject to high heat flux, a method of cooling said engine comprising the steps of:

introducing liquid coolant into a coolant jacket disposed about said structure;

permitting said coolant to boil and produce coolant vapor;

condensing the coolant vapor produced in said coolant jacket to its liquid form in a radiator;

using a pump to return the liquid coolant from said radiator to said coolant jacket in a manner which maintains said structure immersed in a predetermined depth of coolant;

storing liquid coolant in a reservoir;

sensing the load on said pump when energized; and interrupting the communication between said radiator and said pump and establishing fluid communication between said reservoir in which liquid coolant is stored and said pump in response to said step of sensing indicating that the load on said pump is equal to or lower than a predetermined minimum limit.

* * * * *